US006520153B1

(12) United States Patent
Mahr et al.

(10) Patent No.: US 6,520,153 B1
(45) Date of Patent: Feb. 18, 2003

(54) FUEL INJECTION SYSTEM FOR AN INTERNAL COMBUSTION ENGINE

(75) Inventors: Bernd Mahr, Plochingen (DE); Martin Kropp, Kornral-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/807,921

(22) PCT Filed: Aug. 20, 2000

(86) PCT No.: PCT/DE00/02554

§ 371 (c)(1),
(2), (4) Date: Jul. 27, 2001

(87) PCT Pub. No.: WO01/14709

PCT Pub. Date: Mar. 1, 2001

(30) Foreign Application Priority Data

Aug. 20, 1999 (DE) ..... 199 39 426

(51) Int. Cl.[7] ..... F02M 45/04
(52) U.S. Cl. ..... 123/456; 123/447
(58) Field of Search ..... 123/447, 456, 123/457; 239/533.1, 533.2, 88, 5

(56) References Cited

U.S. PATENT DOCUMENTS 3,943,901 A * 3/1976 Takahashi et al. ..... 123/447
4,170,974 A * 10/1979 Kopse et al. ..... 123/445
4,979,674 A * 12/1990 Taira et al. ..... 123/467
5,671,717 A * 9/1997 Rembold et al. ..... 123/25 C
5,722,377 A * 3/1998 Schoenfeld et al. ..... 123/25 C
5,732,679 A * 3/1998 Takahasi et al. ..... 123/447
5,979,410 A * 11/1999 Grishaber ..... 123/300
6,076,504 A * 6/2000 Stavnheim et al. ..... 123/198 D
6,223,699 B1 * 5/2001 Donauer et al. ..... 123/25 C
6,363,914 B1 * 4/2002 Tanabe et al. ..... 123/447
6,378,498 B2 * 4/2002 Kohketsu et al. ..... 123/198 D

FOREIGN PATENT DOCUMENTS

JP 73900 * 3/2001 ..... F02M/45/04

* cited by examiner

*Primary Examiner*—Henry C. Yuen
*Assistant Examiner*—Hai H. Huynh
(74) *Attorney, Agent, or Firm*—Ronald E. Greigg

(57) ABSTRACT

In a fuel injection system for an internal combustion engine, in which fuel can be injected at at least two differently high fuel pressures via injectors into the combustion chamber of the engine, having a central distributor device for distributing the fuel to the individual injectors and having a central pressure reservoir for the lower fuel pressure, one valve unit for switchover between the two fuel pressures is provided locally for each injector individually. Furthermore, the central distributor device for the higher fuel pressure is disposed parallel to the central pressure reservoir for the lower fuel pressure. To enlarge the injection window for the pre-injection and the post-injection, the lower fuel pressure is metered from the central pressure reservoir, without going by way of the distributor device.

6 Claims, 2 Drawing Sheets

FUEL INJECTION SYSTEM FOR AN INTERNAL COMBUSTION ENGINE

CROSS REFERENCE TO RELATED APPLICATIONS

This application is a 35 USC 371 application of PCT/DE 00/02554 filed on Aug. 02, 2000.

BACKGROUND OF THE INVENTION

1. Field of the Invention

The invention is based on a fuel injection system for an internal combustion engine and particularly to such a system in which fuel may be injected at two differently high fuel pressures.

2. Description of the Prior Art

One injection system of the type with which this invention is concerned has been disclosed by European Patent Disclosure EP 0 711 914 A1, for instance.

For better comprehension of the ensuing description, several terms will first be defined in more detail: In a pressure-controlled fuel injection system, a valve body (such as a nozzle needle) is opened counter to the action of a closing force by the fuel pressure prevailing in the nozzle chamber of an injector, and thus the injection opening is uncovered for an injection of the fuel. The pressure at which fuel emerges from the nozzle chamber into the cylinder is called the injection pressure. The term stroke-controlled fuel injection system is understood in the context of the invention to mean that the opening and closing of the injection opening of an injector takes place with the aid of a displaceable valve member on the basis of the hydraulic cooperation of the fuel pressures in a nozzle chamber and in a control chamber. An arrangement is furthermore described below as central when it is provided jointly for all the cylinders, and as local if it is intended for only a single cylinder.

In the pressure-controlled fuel injection system known from EP 0 711 914 A1, with the aid of a high-pressure pump, fuel is compressed to a first, high fuel pressure of about 1200 bar and stored in a first pressure reservoir. The fuel that is at high pressure is also pumped into a second pressure reservoir, in which by regulation of its fuel delivery using a 2/2-way valve, a second high fuel pressure of about 400 bar is maintained. Via a central valve control unit and a central distributor device, either the lower or the higher fuel pressure is carried into the nozzle chamber of an injector. There, by means of the pressure, a spring- loaded valve body is lifted from its valve seat, so that fuel can emerge from the nozzle opening.

In this known fuel injection system, the fuel for an injection from the applicable central pressure reservoir is split via the central valve unit and the central distributor device to the individual injectors. The maximum possible injection window in each case is determined jointly by the valve unit and the distributor device.

SUMMARY OF THE INVENTION

To enlarge the injection window for the lower fuel pressure, that is for the pre-injection or the post-injection, according to the invention the lower fuel pressure is metered directly from the central pressure reservoir, without proceeding by way of the distributor device.

BRIEF DESCRIPTION OF THE DRAWINGS

Further advantages and advantageous features of the subject of the invention can be learned from the description contained below, taken with the drawings, in which.

DESCRIPTION OF THE PREFERRED EMBODIMENTS

Figure 1:
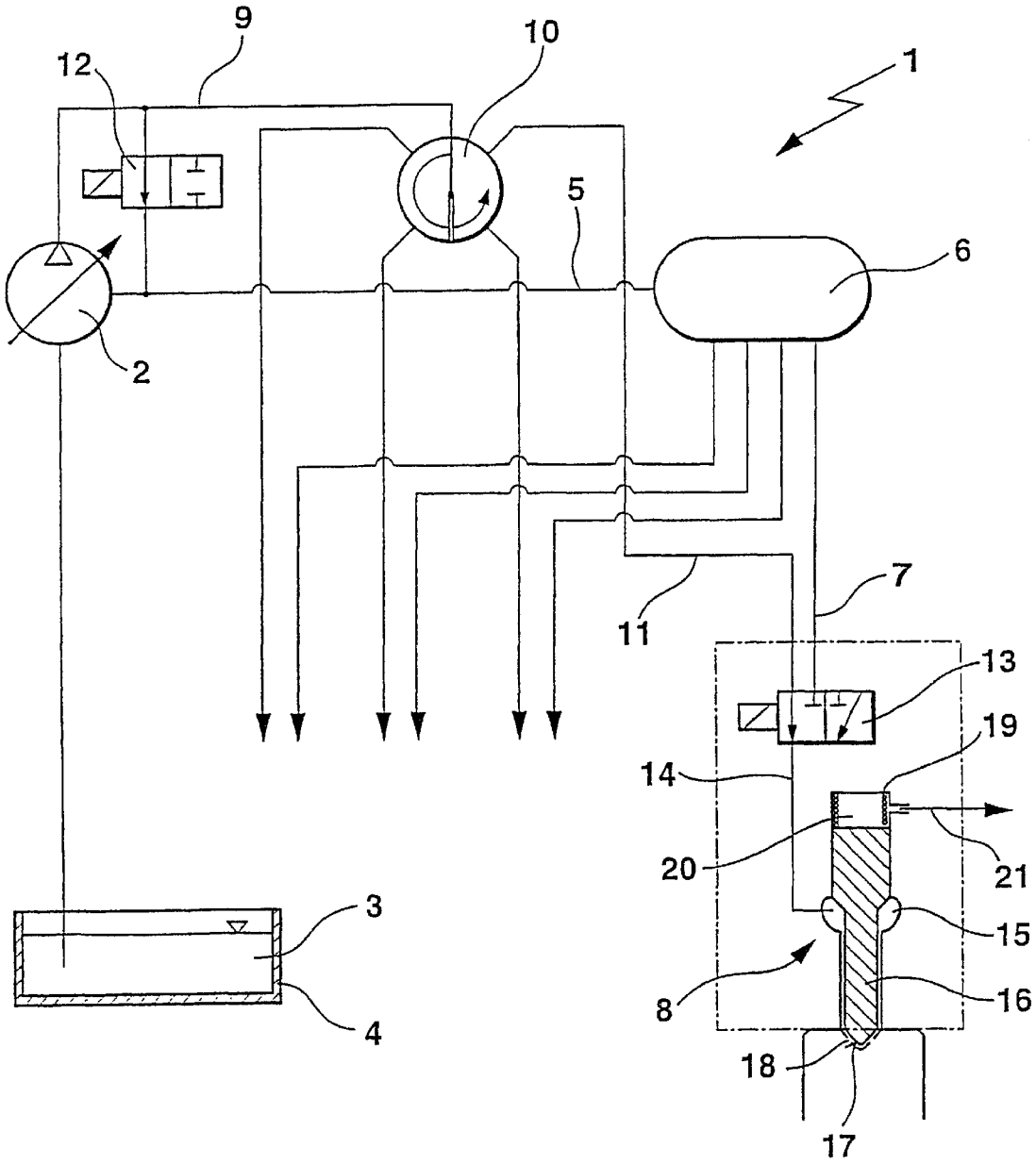
FIG. 1 is a schematic illustration of a fuel injection system with a central pressure reservoir for the lower fuel pressure, with a central distributor device for the higher fuel pressure, and with one local valve unit each for each injector for switching over between the two fuel pressures.

In the pressure-controlled fuel injection system 1 shown in FIG. 1, a two-stage high-pressure pump 2 is used for pumping fuel 3 out of a tank 4 at two different fuel pressures. In the first stage, the fuel is compressed to a first (lower) pressure of about 300 bar and delivered via a feed line 5 to a central pressure reservoir 6 (common rail), in which the fuel is stored at this pressure. From the central pressure reservoir 6, a plurality of first pressure lines 7, corresponding to the number of individual cylinders, lead to the individual injectors 8 (injection devices) protruding into the combustion chambers of the internal combustion engine to be supplied. In FIG. 1, only one of the injectors 8 is shown in detail. The two-stage high-pressure pump 2 can for instance be a cam pump with an injection adjuster, similar to the distributor injection pump known from German Patent Disclosure DE 35 16 867 A1.

In the second stage, the pressure generation to a second (higher) fuel pressure of about 300 bar to about 1800 bar takes place. Via a feed line 9, the fuel is delivered to a central distributor device 10, which distributes the fuel to second pressure lines 11 that likewise lead away to the injectors 8. Since the two feed lines 5, 9 communicate with one another via a 2/2-way valve 12, the higher fuel pressure is not built up until this communication is broken by the supply of electric current to the 2/2-way valve 12. It is equally possible for the two fuel pressures to be generated by two different pumps. To reduce the rpm dependency of the pressure generation, a second pressure reservoir (common rail), in which the fuel is stored at the higher pressure, can be provided upstream of the central distributor device 10.

For each injector 8 individually, a switchover between the lower and the higher fuel pressure can be made at any time during an injection cycle via a local distributor device 13 (3/2-way valve). The applicable pressure is then carried via a pressure line 14 into a nozzle chamber 15 of the injector 8. The injection takes place under pressure control with the aid of a pistonlike valve member 16 (nozzle needle), which is axially displaceable in a guide bore and whose conical valve sealing face 17 cooperates with a valve seat face on the injector housing and thus closes the injection openings 18 provided there. Inside the nozzle chamber 15, a pressure face of the valve member 16, pointing in the opening direction of the valve member 16, is exposed to the pressure prevailing there; via an annular gap between the valve member 16 and the guide bore, the nozzle chamber 15 is extended as far as the valve sealing face 17 of the injector 8. By means of the pressure prevailing in the nozzle chamber 15, the valve member 16 that seals off the injection openings 18 is opened counter to the action of a closing force (closing spring 19), and the spring chamber 10 is relieved by means of a leakage line 21.

A pre-injection at the lower fuel pressure takes place, with the 2/2-way valve 12 currentless, by supplying current to the local valve unit 13. With the local valve unit 13 currentless, supplying electric current to the 2/2-way valve 12 then effects the main injection at the higher fuel pressure. For a post-injection at the lower fuel pressure, the local valve unit 13 is supplied with electric current again.

Figure 2:
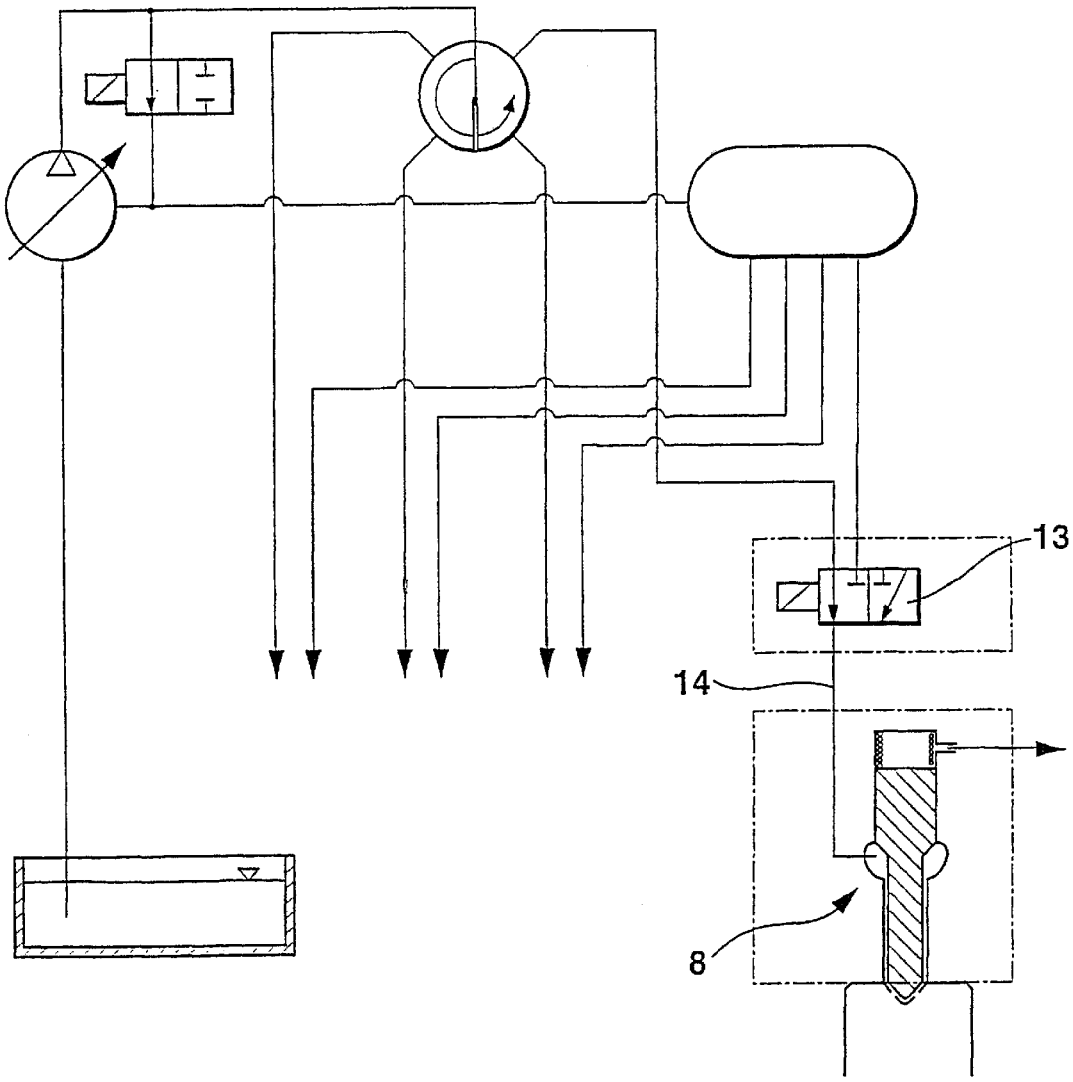
FIG. 2 is an injection system corresponding to FIG. 1, but in which the local valve unit is located outside the injector.

The local valve unit 13 can either be part of the injector housing, as shown in FIG. 1, or can be disposed outside the injector housing (FIG. 2). In the latter case, a smaller structural size of the injector housing can be achieved.

The higher fuel pressure can also be generated via a central pressure booster unit with a refilling and control mechanism. For the higher fuel pressure, a central pressure reservoir can again be provided. Instead of pressure-controlled injectors, stroke-controlled injectors can also be used.

In a fuel injection system 1 for an internal combustion engine, in which fuel can be injected at at least two differently high fuel pressures via injectors 8 into the combustion chamber of the engine, having a central distributor device 10 for distributing the fuel to the individual injectors 8 and having a central pressure reservoir 6 for the lower fuel pressure, one valve unit 13 for switchover between the two fuel pressures is provided locally for each injector 8 individually. Furthermore, the central distributor device 10 for the higher fuel pressure is disposed parallel to the central pressure reservoir 6 for the lower fuel pressure. To enlarge the injection window for the pre-injection and the post-injection, the lower fuel pressure is metered from the central pressure reservoir 6, without going by way of the distributor device 10.

The foregoing relates to preferred exemplary embodiments of the invention, it being understood that other variants and embodiments thereof are possible within the spirit and scope of the invention, the latter being defined by the appended claims.

We claim:

1. In a fuel injection system (1) for an internal combustion engine, in which fuel can be injected at at least two differently high fuel pressures via injectors (8) into the combustion chamber of the engine, having a central distributor device (10) for distributing the fuel to the individual injectors (8) and having a central pressure reservoir (6) for the lower fuel pressure, and having a valve unit (13) for switchover between the two fuel pressures, the improvement wherein, for the switchover between the two fuel pressures, the valve unit (13) is provided locally for each injector (8) individually, and that the central distributor device (10) for the higher fuel pressure is disposed parallel to the central pressure reservoir (6) for the lower fuel pressure.

2. The fuel injection system of claim 1, wherein a different valve unit is provided for each fuel pressure.

3. The fuel injection system of claim 2, wherein the injectors (8) are embodied for a pressure control.

4. The fuel injection system of claim 2, wherein the injectors (8) are embodied for a stroke control.

5. The fuel injection system of claim 1, wherein the injectors (8) are embodied for a pressure control.

6. The fuel injection system of claim 1, wherein the injectors (8) are embodied for a stroke control.

* * * * *

UNITED STATES PATENT AND TRADEMARK OFFICE

CERTIFICATE OF CORRECTION

PATENT NO. : 6,520,153 B1 
DATED : February 18, 2003
INVENTOR(S) : Bernd Mahr et al.

It is certified that error appears in the above-identified patent and that said Letters Patent is hereby corrected as shown below:

Title page,
Item [75], should read as follows:

-- [75] Inventors: Bernd Mahr, Plochingen (De); Martin Kropp, Korntal-Muenchingen, (DE) --

Signed and Sealed this

Seventeenth Day of June, 2003

JAMES E. ROGAN
*Director of the United States Patent and Trademark Office*